US006994658B2

(12) United States Patent
Laudenslager et al.

(10) Patent No.: US 6,994,658 B2
(45) Date of Patent: Feb. 7, 2006

(54) MODULAR HEAVY BAG

(75) Inventors: Andrew R. Laudenslager, Allentown, PA (US); Peter B Pecsvaradi, Portland, ME (US)

(73) Assignee: Balazs Inc., Allentown, PA (US)

( * ) Notice: Subject to any disclaimer, the term of this patent is extended or adjusted under 35 U.S.C. 154(b) by 203 days.

(21) Appl. No.: 10/298,765

(22) Filed: Nov. 18, 2002

(65) Prior Publication Data

US 2004/0097348 A1 May 20, 2004

(51) Int. Cl.
*A63B 21/00* (2006.01)

(52) U.S. Cl. ..... 482/83; 482/87; 482/90

(58) Field of Classification Search ..... 482/83–90; 473/441, 442

See application file for complete search history.

(56) References Cited

U.S. PATENT DOCUMENTS 4,103,889 A * 8/1978 Lobur 6,558,298 B2 * 5/2003 Fields

* cited by examiner

*Primary Examiner*—Jerome W. Donnelly
(74) *Attorney, Agent, or Firm*—Richard P. Gilly; Fish & Richardson P.C.

(57) ABSTRACT

A heavy bag uses one or more removable canisters placed inside a cover, substantially filling the cover and thereby forming a modular construction for the heavy bag. The cover has a selectively resealable closure which permits the canister or canisters to be inserted into or removed from the cover. The bag is formed from a set of the canisters within the cover. In one embodiment of the invention, the canisters are not all filled with the same stuffing material, causing the densities or hardnesses of the canisters to differ from each other, thereby creating zones of differing hardnesses within the bag. The canisters are preferably filled with stuffing material in the form of sand, pieces of rag, liquid, gel, foam, or egg-crate foam. The invention can include a structure to avoid separation of opposing surfaces of adjacent canisters received in the cover of the bag.

34 Claims, 2 Drawing Sheets

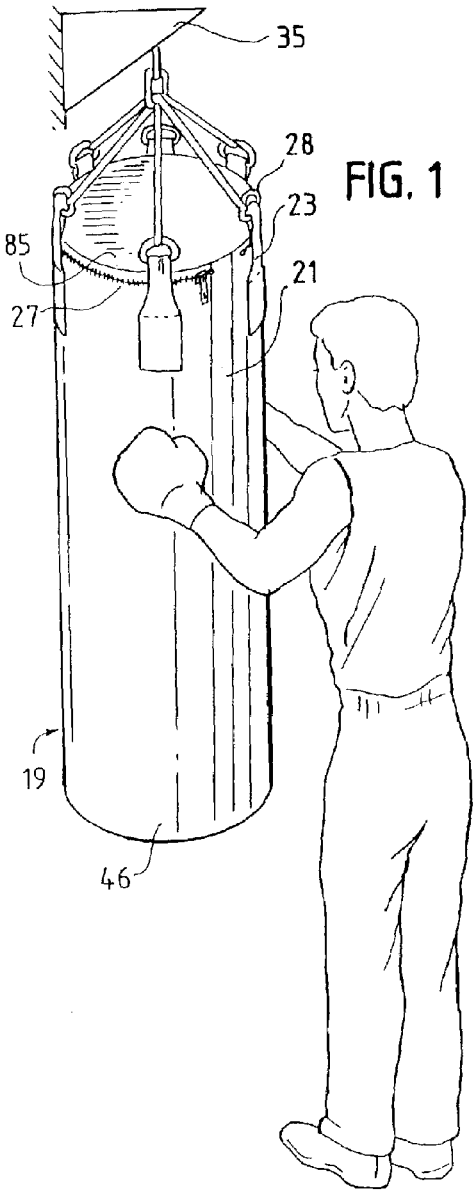
FIG. 1
FIG. 4
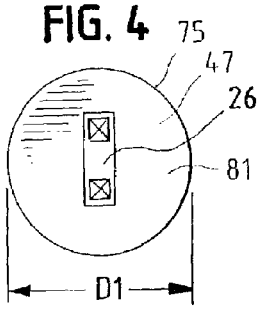
FIG. 2
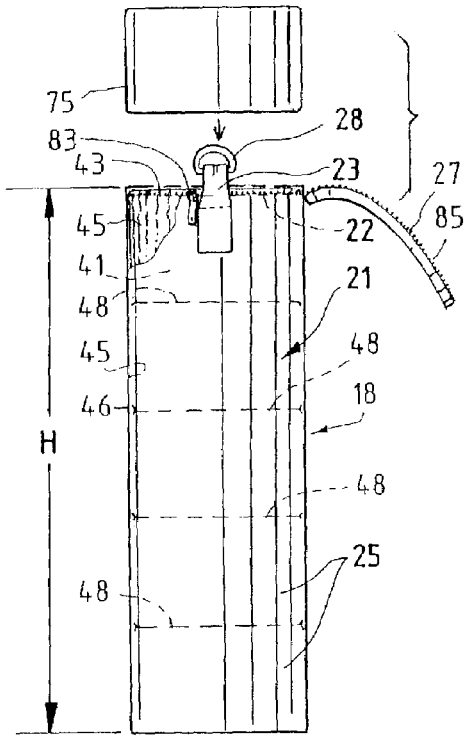
FIG. 5
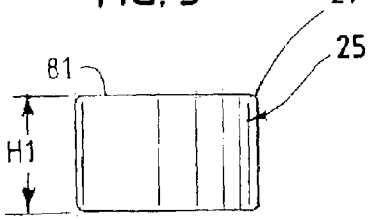
FIG. 3
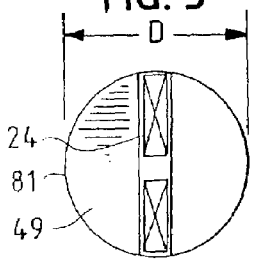

MODULAR HEAVY BAG

FIELD OF THE INVENTION

This invention relates to exercise equipment and, more particularly, to heavy bags used in boxing, the martial arts, and for other athletic purposes.

BACKGROUND OF THE INVENTION

Certain punching bags, known as heavy bags, are used in boxing, martial arts and other athletic activity, and are thus subjected to strenuous use. This causes the bags to become worn heavily, thus requiring regular maintenance and repair. Maintenance and repair, in turn, are generally difficult on such punching bags for a variety of reasons. For example, any rips, tears, punctures or other breaches in the outer covering must generally be well sealed to avoid escape of stuffing material.

The stresses experienced by striking the bag may also reopen previous repairs. As such, any significant rip, tear, or hole in the bag generally compromises the structural integrity of the entire bag and renders it substandard at a minimum, if not unusable in more extreme cases.

In addition, heavy bags are generally constructed substantially of a unitary outer shell and usually filled with a combination of pieces of cloth or thread, and sand. This makes the bags cumbersome in many respects, including shipping, handling, relocating, and repairing. In particular, since these bags are one piece and usually weigh more than seventy pounds, the bags exceed the weight limits for certain types of shipping, requiring special handling or otherwise limiting shipping options. Warehousing and storage are similarly rendered more cumbersome as suitable personnel and equipment must be present to move the bags as required.

The sand or other stuffing material of heavy bags presents its own further drawbacks. For example, over time, the sand or other stuffing material tends to settle at the bottom of the bag. This causes the density of the bag to shift, which creates soft spots at the top of the bag and firm spots toward the bottom, both of which are counterproductive to optimum training.

It is therefore desirable to create a heavy bag that performs better by avoiding the settling effect of the stuffing material, and that is easy to maintain, repair, store and ship.

BRIEF DESCRIPTION OF THE DRAWING

The invention will be better understood by reference to the attached drawing. It is understood that the drawing is for illustrative purposes only and is not necessarily drawn to scale. In fact, certain features of the drawing are shown in more detail for purposes of explanation and clarification.

FIG. 1 is a perspective view of a preferred embodiment of an exercise bag according to the present invention, along with a user thereof.

FIG. 2 is a side view of the embodiment of FIG. 1, showing how the cover is filled with canisters.

FIG. 3 is a bottom view of one of the canisters of the embodiment of FIGS. 1 and 2.

FIG. 4 is a top view of the canister of FIG. 3.

FIG. 5 is a side view of the canister of FIGS. 3 and 4.

SUMMARY OF THE INVENTION

Figure 6:
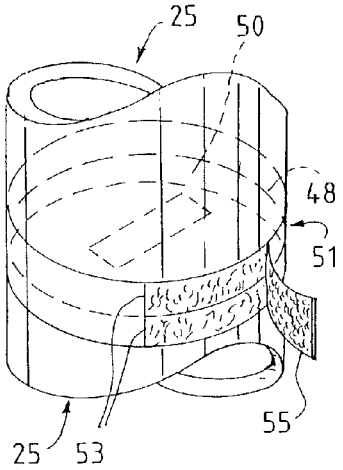
FIG. 6 is a perspective, partial view of one suitable arrangement for reducing separation of adjacent canisters.

According to the present invention, the foregoing and other objects and advantages are attained by a heavy bag that uses one or more removable canisters placed inside a cover, substantially filling the cover and thereby forming a modular construction for the heavy bag. The cover has a selectively resealable closure which permits the canister or canisters to be inserted into or removed from the cover. If the bag is formed from a set of the canisters within the cover, then, in one version of the invention, the canisters are not all filled with the same stuffing material. In this way, the densities or hardnesses of the canisters differ from each other, thereby creating zones of differing hardnesses within the bag. Canisters are preferably filled with stuffing material in the form of sand, pieces of rag, liquid, gel, foam, rubber, particles or pellets of rubber, egg-crate foam, or any other suitable aggregate material.

The invention optionally includes a structure to avoid separation of opposing surfaces of adjacent canisters received in the cover of the bag. One version of this structure is a VELCRO attachment system at the opposing surfaces of adjacent canisters. In another version, a ring fits at the opposing ends of the adjacent canisters.

The canisters which fill the bag have cylindrical sidewalls, according to one aspect of the invention, with either flat or cone-shaped top and bottom surfaces. According to another aspect of the invention, the canisters are segments of a cylinder, occupying a selected arc of the 360 degrees of the circular cross section of the cylindrical bag.

DETAILED DESCRIPTION OF THE PREFERRED EMBODIMENTS

Referring now to the drawings, and in particular to FIGS. 1–5, a heavy bag 19 is suspended from a mount shown schematically at 35 for use in boxing, exercise, martial arts, or for other athletic purposes. Heavy bag 19 is modular by virtue of being constructed of at least two, separable components. Modular heavy bag 19 preferably comprises multiple canisters 25 filled with stuffing material, as described subsequently, and removably received in cover 21. Although the number of canisters 25 received in cover 21 is variable depending on any number of factors, the illustrated embodiment includes a canister set 18, which, in turn, comprises five of the canisters 25, and the canisters 25 of canister set 18 are drum-shaped, and equally sized.

As best seen in FIG. 2, canisters 25 are inserted through resealable opening 43 into the inner volume 41 of cover 21. Cylindrical sidewalls 75 of drum-shaped canisters 25 fit generally snugly against opposing inner wall 45. Otherwise stated, in order to assure that canisters 25 fit fairly tightly within cover 21, outer diameter D of canisters 25 is substantially equal to the corresponding inner diameter formed by inner wall 45 of cover 21.

A representative one of canisters 25 is shown in FIGS. 3–5. Height H1 of canister 25 is selected so that, when the requisite number of canisters has been received into inner volume 41 of cover 21, the plurality of canisters 25 substantially fills inner volume 41 to form heavy bag 19. The term "substantially fills" used herein means that heavy bag 19 has sufficient weight, hardness, and size to be used as intended. Top 47 of canister 25 and bottom 49 thereof are substantially flat in this embodiment to allow relatively straightforward stacking of canisters 25 in any order within cover 21.

The five canisters 25 are filled with any suitable stuffing material, such as sand, which sand optionally includes thread, cloth or rags intermixed therewith. Substitute or alternative stuffing materials are likewise useful to fill one or more of the canisters 25. Such stuffing materials preferably include liquid, gel, egg-crate-like foam material, or other types of foam, but such stuffing materials are not so limited, also including any other filling materials which vary in hardness, density, weight, or other characteristics from the more typical sand found in heavy bags.

Using different stuffing materials in one or more canisters 25 creates variety in the hardness, density, weight, or other characteristics among the canisters of the set of canisters 25, and thus in heavy bag 19. Accordingly, the hardness or other characteristics of heavy bag 19 can be customized to specific users or uses by selecting different stuffing materials for all or some of canisters 25, or by combining one or more canisters 25 filled with one type of stuffing material, with one or more canisters filled with another type or types of stuffing materials. As such, canisters 25 can each be filled with identical stuffing material, each can be of a different stuffing material, or any variation of the foregoing, such as having one or more canisters formed of one stuffing material, and the remaining canisters formed of another stuffing material or materials. It will be appreciated that the numerous combinations and variations to the stuffing materials filling canisters 25, and the different number of canisters 25 filled with given stuffing material or materials, are all within the scope of the invention.

By having the canister set 18 comprised of canisters of different stuffing materials, the heavy bag 19 thus created includes one or more zones of different hardness at selected location(s) therein. For example, canister set 18 is optionally provided with a canister 25 of softer stuffing material, and cover 21 is filled with canisters 25 so that the softer canister is at a medial location (that is, in the middle) of cover 21, with the remaining canisters 25 being filled with denser stuffing material. This creates a softer area at such medial location in heavy bag 19, which, in a sense, simulates a human stomach.

It is preferable for outer wall 46 of heavy bag 19 to present uniform resistance to the user, unless, of course, a zone of varying hardness or density has been provided through the use of differing stuffing material as outlined above. Otherwise stated, the user should encounter substantially the same resistance at all points when striking heavy bag 19, unless a zone of varying hardness or density has been intended. With this goal in mind, it is possible that resistance of heavy bag 19 may vary at horizontal boundaries 48 formed between opposing surfaces 50 of adjacent canisters 25. This is especially the case if opposing surfaces 50 are forced apart, such as by blows applied at or near horizontal boundaries 48 of canisters 25. The risk of such inadvertent separation of opposing surfaces 50 is reduced by selecting heights or height H1 of canisters 25 so that the combined height of the stacked canisters is approximately equal to the height of cover 21.

In this preferred embodiment, canisters 25 have a height H1 of approximately 8 to 12 inches, making a combined height of about 40 to 60 inches for heavy bag 19.

Bag 19 is optionally equipped with a component which avoids unintentional separation at opposing surfaces 50. For example, bag 19 is equipped with one or more components which secure canisters 25 relative to each other when positioned inside cover 21. Referring to FIG. 6, opposing canister surfaces 50 are secured relative to each other by a Velcro fastening arrangement 51. Velcro part 53, either comprised of the hooks or the eyes, is secured to extend at least partially along the circumference of canister sidewalls near corresponding opposing surfaces 50 thereof. Velcro part 55 preferably comprises a belt with a surface which includes the Velcro fasteners to mate with the first Velcro parts 53 near opposing surfaces 50. Belt-shaped part 55 is sufficiently wide to be secured simultaneously to both Velcro parts 53 when opposing surfaces 50 are brought against each other.

Canisters 25 are thus attached and then inserted into inner volume 41 of cover 21. Velcro part 55 preferably is sufficiently long to wrap around the entire circumference of the canisters 25, thereby effectively eliminating access to horizontal boundary 48 from blows received against cover 21.

Velcro fastening arrangement 51 is not limited to the parts 53 and 55 as described above. Alternately, Velcro parts 53, 55 can be directly applied to opposing surfaces 50, as shown in the embodiment shown in FIG. 7. In such an arrangement, adjacent canisters become secured relative to each other after they are inserted into cover 21 when they are inserted serially into cover 21 with mating Velcro parts 53, 55 on opposing surfaces 50, and resist separation at boundary 48. Canisters 25 in this embodiment can also be secured before insertion into cover 21.

Figure 7:
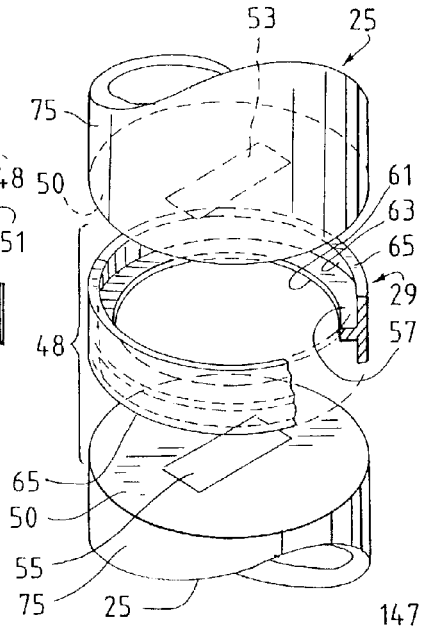
FIG. 7 is a perspective, partial view of an alternate arrangement for reducing separation of adjacent canisters.

Inadvertent separation at boundary 48 is alternately or further reduced by inserting a ring 29 between opposing surfaces 50 as shown in FIG. 7. Ring 29 is preferably made of polymeric material, foam, rubber or other malleable material and includes flanges 65 extending outwardly from its planar, central portion at the outer diameter of ring 29. The general structure of ring 29, then, is for a planar, central portion to extend between its inner and outer perimeters 61, 63, and a thicker portion to be formed by flange 65 located at the outer diameter of ring 29. A ring seat 57 thus is formed, and flange 65 is located so that canisters 25 sit snugly on ring seat 57 within flange 65, resisting inadvertent separation by virtue of such fit.

Flange 65 extends partially along sidewalls 75 of adjacent canisters 25 at the opposing ends of such canisters. As such, horizontal boundary 48 is not as readily subject to separating forces from blows received at such boundary, since such blows strike the outer wall of flange 65.

Figure 8:
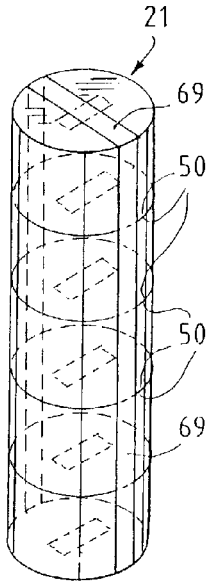
FIG. 8 is a perspective view of still another arrangement for reducing separation of adjacent canisters.

FIG. 8 shows still another device for reducing inadvertent separation of opposing surfaces 50 of adjacent canisters 25, that is, a tie down strap 69 in the cavity defined by inner wall 45 (FIG. 9) of cover 21. Strap 69 is fastenable relative to one or more canisters 25 to exert inward, compressive force on the canisters to resist separation for the opposing surfaces thereof. In the illustrated example, strap 69 extends from the bottom of the cavity inside cover 21, up opposing, longitudinal sides of cover 21, and extends across the inside of the cavity at the top of cover 21. The strap thus encircles all canisters of the set received in cover 21 and, when cinched, exerts the required compressive force to hold the set of canisters 25 together.

Figure 9:
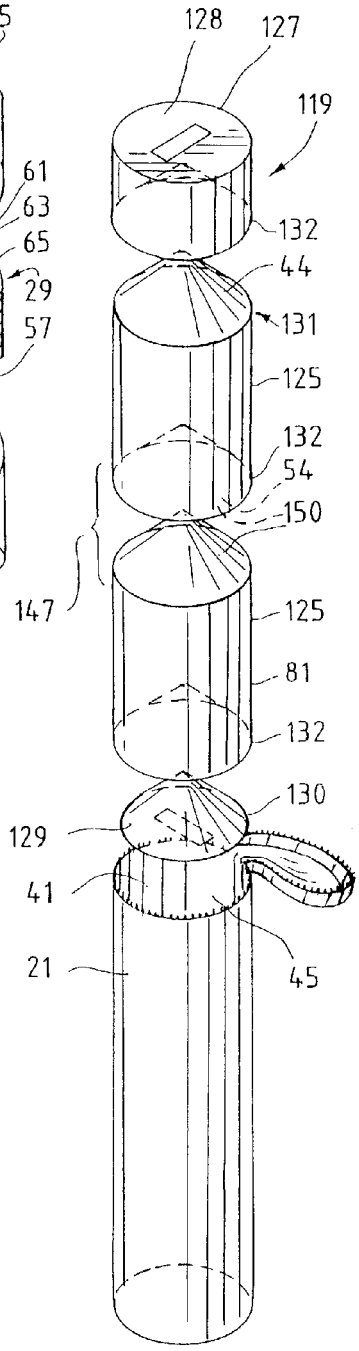
FIG. 9 is an exploded perspective view of an alternate embodiment of the bag of FIG. 1.
Figure 10:
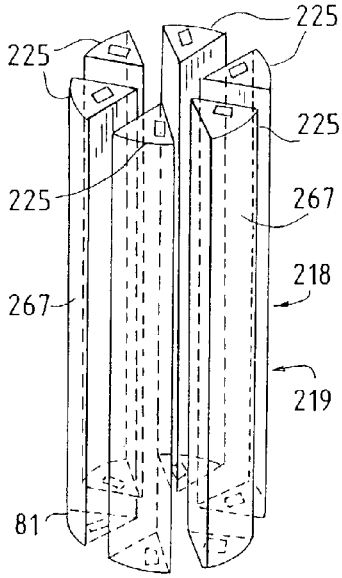
FIG. 10 is a perspective view of another alternative embodiment of the present invention.

Although the preceding embodiments have shown drum-shaped canisters substantially filling volume 41 of cover 21, alternate shapes of canisters are within the scope of the current invention, two examples of which are shown in FIGS. 9 and 10. In FIG. 9, canisters 125 have outwardly extending cones 44 formed in respective tops 131 and have corresponding cone-shaped cavities 54 formed in bottoms 132. In this manner, cones 44 are received into corresponding cavities 54, thereby making an angled joint or boundary 147 between opposing surfaces 150 of canisters 125. It will be appreciated that generally horizontal blows applied to boundary 147 will be less prone to separate opposing surfaces 150 by virtue of such an angled boundary or seam.

The resulting heavy bag 119 includes top and bottom canisters 127, 129 which differ in shape from canisters 125, which have at intermediate positions within cover 21. Top canister 127 includes a cone-shaped cavity formed in its bottom 132 to mate with a corresponding cone 44, but is formed with a generally horizontal top surface 128, to allow an even filling of the volume 41 of cover 21. Similarly, bottom canister 129 includes an outwardly extending cone 44, but a generally horizontal bottom 130 to uniformly fill the bottom portion of volume 41. In an alternative embodiment, not shown, the bottom canister is similar to top canister 127, that is, a cylindrical canister with a convex cone extending from the top of the cylindrical form and a flat bottom.

Canisters 225 shown in FIG. 10 comprise a set of six, wedge shapes arranged adjacent to each other. Canisters 225 have outer sidewalls 267 extending through an arc of approximately sixty degrees, and radial walls approximately corresponding to the radius of the volume of cover 21. In this way, canisters 225 substantially fill the volume 41 of cover 21, while still allowing resulting heavy bag 219 to be modular. As in the previous embodiments, canisters 225 are filled with stuffing material, and such stuffing material can be varied either by individual canister 225 or by canister sets 218 to meet individual demands of users. When a canister 225 is filled with stuffing material having a different characteristic from that of the other canisters 225, that variation is preferably present over the entire length of heavy bag 219, but only along the sixty degree segment of the outer cover 21 corresponding to such different canister 225. It will, of course, be appreciated that the stuffing materials of canisters 225 can be varied just as with the other canisters 25, 125, discussed previously.

The canisters 25, 125, 225 include an outer casing 81 of suitably durable material, such outer casing 81 formed to assume the desired shape of the canister when the casing is filled with stuffing material, such as the drum-like shapes of canisters 25. The casing is preferably formed to encapsulate the stuffing material, that is, the stuffing material is not readily accessible by the user because the casing has no resealable opening for the user. As such the casing is substantially continuous. Alternately, suitable openings (not shown) can be provided to access stuffing material received in the casing 81. Canisters 25, 125, 225 are equipped with suitable handles or loops to assist in inserting or removing them from cover 21. In the illustrated embodiments of FIGS. 3–5, a nylon strap 26 is secured to casing 81 at top 47, and strap 24 is secured to casing 81 at bottom 49.

Modular heavy bag 19, 119, and 219 is provided with any of the usual means for mounting it to stands or to otherwise allow it to be used as intended. In the illustrated embodiment of FIGS. 1–5, suitable nylon straps 23 are secured to outer cover 21, with suitable clips or rings for receiving chains, cables, S-hooks, or other mounting hardware, as required by the particular application.

The cover 21 is preferably made of either leather or canvas. All of the seams on the cover 21 are preferably lock stitched four times per seam. Foam is optionally included along the inner wall 45 of the cover to line the inner volume thereof. Such foam lining lessens the accessibility from outside of cover 21 to the opposing surfaces 50 of adjacent canisters 25, adds some give to the outside of the cover 21, and causes friction against the canisters, thus further securing them relative to each other.

The volume 41 of cover 21 is preferably accessed through an opening 83, which is closed after insertion of the desired canisters into volume 41. Opening 83 is preferably closed by securing top 85 over it, which substantially corresponds to the top, circular surface of the heavy bag. Top 85 is preferably secured by a zipper 27 which runs substantially around the circumference of top 85. Alternately, top 85 can be stitched shut in the event the manufacturer does not wish the purchaser to readily access the volume 41 and the canisters contained therein.

The desired dimensions for the cover 21 preferably correspond to standard sizes for the sport in which the bag is to be used, such as boxing, and thus form heavy bags approximating certain corresponding weights. Typical dimensions in inches include 12×24, 12×60, 12×72, 14×36, 14×36 (horizontal), 14×48, 18×48, and 18×60.

In addition to the advantages apparent from the foregoing description, the user can rotate the canisters regularly to reduce undesirable settling effects of the stuffing material within the bag.

As another advantage, the user can also maintain and repair the heavy bag more easily because any one of the modular components can be removed or separated from the heavy bag, and then repaired or replaced.

Yet another advantage is that, because the heavy bag is modular, its components can be separately packaged and thus shipped and stored more easily.

The use of multiple, modular canisters of different stuffing material has the still further advantage of permitting the heavy bag to be custom-made with a certain overall hardness, density or weight, or to create custom zones of differing characteristics (such as hardness, density or weight) at selected locations on the heavy bag.

It will be appreciated that those skilled in the art may vary certain structures and dimensions of the invention, and may otherwise construct variations which skill or fancy may suggest. Such variations are within the scope of the present invention, which is delimited by the following claims, and is not limited by the preferred embodiment.

What is claimed is:

1. A heavy bag used for boxing, exercise, martial arts, or other athletic purposes, the heavy bag comprising:

a cover having an outer wall for receiving blows from the user of the bag and an inner wall defining a cavity having a volume, said cover including a non-detachable suspension means attached to said cover;

a plurality of canisters filled with stuffing material, wherein the canisters correspond to predetermined surface areas of the cover capable of being engaged by the user of the bag, the canisters being removably received in the cavity; and the cover having a selectively resealable closure adapted to permit insertion or removal of the canister therethrough.

2. The heavy bag of claim 1, wherein the plurality of canisters substantially fills the volume of the bag.

3. The heavy bag of claim 2, comprising a plurality of stuffing materials, the stuffing materials having different corresponding densities.

4. The heavy bag of claim 3, wherein different stuffing materials fill corresponding canisters to vary the hardness of the canisters relative to each other.

5. The heavy bag of claim 4, wherein the stuffing materials are selected as a function of at least one of weight, hardness and density.

6. The heavy bag of claim 4, wherein the stuffing materials are selected from the group consisting of sand, pieces of rag, gel, liquid, foam, rubber, particles or pellets of rubber, and egg foam.

7. The heavy bag of claim 3, wherein each of the canisters is filled with the same stuffing material.

8. The heavy bag of claim 3 comprising at least two stuffing materials having different respective characteristics, at least one canister being filled with the first stuffing material and at least one canister being filled with the second stuffing material to create respective zones of different hardnesses in the bag.

9. The heavy bag of claim 3, wherein the stuffing materials fill the canisters in such a manner to vary the hardness of at least one of the canisters relative to another one of the canisters.

10. The heavy bag of claim 9, wherein the canister of varying hardness is softer and is stacked relative to the other canister to be located at a medial location in the bag, thereby simulating the resistance of the human stomach.

11. The heavy bag of claim 1, wherein each canister of the plurality of canisters includes a casing, the stuffing material being received in the casing.

12. The heavy bag of claim 11, wherein the casing is substantially continuous to prevent occasional users from accessing the stuffing material received therein.

13. The heavy bag of claim 2, wherein the canisters comprise mating surfaces received in one another when the canisters are inserted into the cover.

14. The heavy bag of claim 1, wherein the cover comprises opposite top and bottom ends and a cover wall extending therebetween, at least one of the ends having at least one strap secured thereto for mounting the heavy bag for its intended use, and wherein the resealable closure is located at one of the ends of the cover and includes a zipper.

15. A heavy bag used for boxing, exercising, martial arts, or other athletic purposes, the heavy bag comprising:

a cover having an outer wall for receiving blows from a user and an inner wall defining a cavity having a volume, said cover including a non-detachable suspension means attached to said cover;

a plurality of canisters removably received in the cavity and sized to substantially fill the volume of the bag, at least one of the canisters being filled with a first stuffing material, and at least one other canister being filled with another stuffing material having a different density from the first stuffing material to form a zone of differing hardness within the heavy bag when the canisters are received in the cover;

the cover having a selectively resealable closure adapted to permit insertion or removal of the canisters therethrough; and the heavy bag further comprising a device for preventing adjacent ones of the canisters from separating relative to each other.

16. A method of making a heavy bag for boxing, exercise, martial arts, or other athletic purposes, the method comprising:

providing a cover with an outer wall for receiving blows from a user, an inner wall defining a cavity having a volume, said cover including a non-detachable suspension means attached to said cover, and an opening through which the volume can be accessed;

inserting canisters filled with stuffing material into the volume of the cover through the opening to substantially fill the volume, wherein the canisters correspond to predetermined surface areas of the cover capable of being engaged by the user of the bag; and closing the opening of the cover to retain the canisters therein.

17. The method of claim 16, further comprising the step of attaching the canisters relative to each other to minimize separation of the opposing surfaces of adjacent canisters.

18. The method of claim 16 for making multiple heavy bags of varying hardness on demand and further comprising the steps of:

creating an inventory of the canisters having different physical characteristics of weight, hardness, or density;

classifying the inventory of canisters according to the characteristics of weight, hardness or density;

selecting canisters from the inventory to form a set of the canisters corresponding to the heavy bag of varying hardness which has been demanded; and inserting the set of canisters into the cover at locations therein to create the desired heavy bag of varying hardness in accordance with the demand.

19. The method of claim 18 comprising the step of filling the canisters with stuffing materials selected from the group consisting of gel, liquid, foam, egg foam, pieces of rag, rubber, particles or pellets of rubber, and sand.

20. A method of repairing a heavy bag used in boxing, exercise, martial arts, or other athletic activities, the method comprising:

providing a plurality of modular components, including a cover with an inner wall defining a volume, said cover including a non-detachable suspension means attached to said cover and an opening for accessing the volume, and a plurality of canisters removably receivable in the cover and sized to substantially fill the volume of the heavy bag, wherein the canisters correspond to predetermined surface areas of the cover capable of being engaged by the user of the bag, at least one of the modular components being in need of repair;

removing the modular component in need of repair from the cover;

replacing the modular component in need of repair with a corresponding modular component; and reassembling the modular components within the cover to form the heavy bag.

21. A method of renovating a heavy bag to reduce effects of settling of the stuffing material therein, the method comprising:

providing a plurality of modular components, including a cover with an inner wall defining a volume, said cover including a non-detachable suspension means attached to said cover and an opening for accessing the volume, and a set of canisters filled with stuffing material, the set of canisters substantially filling the volume of the heavy bag, the canisters of the set received in the cover at corresponding first locations therein;

removing the canisters from the cover and reinserting at least two of the canisters at corresponding second locations, the corresponding second locations differing from the first locations of the two canisters, whereby the set of canisters has been rotated to avoid settling effects, thereby renovating the heavy bag.

22. The method of claim 21, wherein each of the canisters of the set is reinserting at a corresponding second location different from the corresponding first location.

23. A heavy bag used for boxing, exercise, martial arts, or other athletic purposes, the heavy bag comprising:

a cover having an outer wall for receiving blows from the user of the bag and an inner wall defining a cavity having a volume, said cover including a non-detachable suspension means attached to said cover;

a plurality of canisters received in the cover, wherein the plurality of canisters substantially fills the volume of the bag, wherein the canisters include sidewalls and are sized so that the sidewalls oppose the inner wall of the cover to friction fit therein, wherein the canisters are arranged in series in the cavity to form adjacent canisters, the adjacent canisters having respectively opposing surfaces, and wherein at least one canister is filled with stuffing material, the canister being removably received in the cavity; and the cover having a selectively resealable closure adapted to permit insertion or removal of the canister there through.

24. A heavy bag used for boxing, exercise, martial arts, or other athletic purposes, the heavy bag comprising:

a cover having an outer wall for receiving blows from the user of the bag and an inner wall defining a cavity having a volume, said cover including a non-detachable suspension means attached to said cover;

a plurality of canisters received in the cover, wherein the plurality of canisters substantially fills the volume of the bag, and wherein at least one canister is filled with stuffing material, the canister being removably received in the cavity;

the cover having a selectively resealable closure adapted to permit insertion or removal of the canisters there through; and a device for preventing the canisters from separating relative to each other.

25. The heavy bag of claim 24, wherein the device comprises a VELCRO fastening arrangement.

26. The heavy bag of claim 25, wherein the canisters include sidewalls and are sized so that the sidewalls oppose the inner wall of the cover to friction fit therein, wherein the canisters are arranged in a series in the cavity to form adjacent canisters, the adjacent canisters having a respective, opposing ends, and wherein the VELCRO fastening arrangement comprises a VELCRO part secured to the sidewalls of two adjacent canisters at the opposing ends thereof.

27. The heavy bag of claim 25, wherein the VELCRO fastening arrangement comprises mating hook and eye patches secured to the canisters.

28. The heavy bag of claim 24, wherein the device comprises means for attaching the canisters relative to each other.

29. The heavy bag of claim 28, wherein the device comprises at least one strap in the cavity, the strap being fastenable relative to the canisters to exert compressive force on the canisters to resist separation thereof.

30. The heavy bag of claim 24, wherein the device comprises a flange located between the canisters.

31. The heavy bag of claim 24, wherein the canisters include sidewalls and are sized so that the sidewalls oppose the inner wall of the cover to friction fit therein, wherein the canisters are arranged in series in the cavity to form adjacent canisters, the adjacent canisters having respective, opposing surfaces, and wherein the device comprises a ring, the ring comprising a seat for receiving the opposing surfaces of adjacent canisters thereon, and a circumferential flange extending partially along the sidewalls of the adjacent canisters at the opposing surfaces thereof.

32. A heavy bag used for boxing, exercise, martial arts, or other athletic purposes, the heavy bag comprising:

a cover having an outer wall for receiving blows from the user of the bag and an inner wall defining a cavity having a volume, said cover including a non-detachable suspension means attached to said cover;

a plurality of canisters received in the cover, wherein the plurality of canisters substantially fills the volume of the bag, wherein the canisters comprise mating surfaces received in one another when the canisters are inserted into the cover, wherein the mating surface of one of the canisters is formed into an outwardly extending cone and the mating surface of an adjacent one of the canisters is formed into a cavity for receiving the cone therein, thereby forming an angled boundary between the corresponding canisters, and wherein at least one canister is filled with stuffing material, the canister being removably received in the cavity; and the cover having a selectively resealable closure adapted to permit insertion or removal of the canisters there through.

33. A heavy bag used for boxing, exercise, martial arts, or other athletic purposes, the heavy bag comprising:

a cover having an outer wall for receiving blows from the user of the bag and an inner wall defining a cavity having a volume, said cover including a non-detachable suspension means attached to said cover;

a plurality of canisters received in the cover, wherein the plurality of canisters substantially fills the volume of the bag, wherein the canisters are wedge-shaped and situated adjacent to each other, and wherein at least one canister is filled with stuffing material, the canister being removably received in the cavity; and the cover having a selectively resealable closure adapted to permit insertion or removal of the canisters there through.

34. A method of making a heavy bag for boxing, exercise, martial arts, or other athletic purposes, the method comprising:

providing a cover with an outer wall for receiving blows from a user, an inner wall defining a cavity having a volume, said cover including a non-detachable suspension means attached to said cover and an opening through which the volume can be accessed; filling canisters with stuffing materials having different corresponding densities to vary the hardness of the canisters relative to each other;

stacking the canisters longitudinally within the volume of the cover to substantially fill the volume to form zones of varying hardness at corresponding longitudinal locations along the heavy bag; and closing the opening of the cover to retain the canisters therein.

* * * * *